US009733043B1

(12) United States Patent
Cohen

(10) Patent No.: US 9,733,043 B1
(45) Date of Patent: Aug. 15, 2017

(54) DEVICES AND METHODS FOR IMPROVING THE GRIP OF A SLIDE ASSOCIATED WITH A SEMI-AUTOMATIC WEAPON

(71) Applicant: Yosef Cohen, Yehud (IL)

(72) Inventor: Yosef Cohen, Yehud (IL)

(73) Assignee: Yosef Cohen, Yehud (IL)

( * ) Notice: Subject to any disclaimer, the term of this patent is extended or adjusted under 35 U.S.C. 154(b) by 0 days.

(21) Appl. No.: 15/155,092

(22) Filed: May 16, 2016

(51) Int. Cl.
*F41C 27/00* (2006.01)
*F41A 35/06* (2006.01)
*F41C 3/00* (2006.01)

(52) U.S. Cl.
CPC ..... *F41C 27/00* (2013.01); *F41A 35/06* (2013.01); *F41C 3/00* (2013.01)

(58) Field of Classification Search
CPC .. F41C 27/00; F41A 35/06; F41A 7/00; F41A 7/02
USPC ..... 42/90; 89/1.4
See application file for complete search history.

(56) References Cited

U.S. PATENT DOCUMENTS 1,680,186 A * 8/1928 Von Frommer ..... F41A 3/66 42/106
6,775,940 B2 * 8/2004 Dworzan ..... F41A 17/06 42/1.01
8,015,741 B2 * 9/2011 Hooks ..... F41A 17/46 42/70.01
8,181,378 B2 * 5/2012 Losinger ..... F41C 23/10 42/71.02
8,312,803 B2 * 11/2012 Oz ..... F41A 19/34 42/71.02
8,468,734 B2 * 6/2013 Meller ..... F41A 3/72 42/71.02
D702,800 S * 4/2014 Speroni ..... D22/108
D724,689 S * 3/2015 Sui ..... D22/108
9,121,662 B1 * 9/2015 Love ..... F41C 27/00
9,157,691 B2 * 10/2015 Parnell ..... F41A 7/00
9,194,654 B1 * 11/2015 Viani ..... F41C 27/00
9,267,759 B2 * 2/2016 Speroni ..... F41C 27/00
9,423,209 B1 * 8/2016 Hoeffken ..... F41A 35/00
2003/0134088 A1 * 7/2003 Chen ..... A63B 49/08 428/156
2009/0258195 A1 * 10/2009 Lauer ..... F41H 3/02 428/195.1
2011/0010978 A1 * 1/2011 Hooks ..... F41A 17/46 42/69.01
2011/0088539 A1 * 4/2011 Oz ..... F41A 19/34 89/1.4
2011/0154710 A1 * 6/2011 Hatfield ..... F41A 19/34 42/90
2011/0289812 A1 * 12/2011 Losinger ..... F41C 23/10 42/72
2012/0198744 A1 * 8/2012 Meller ..... F41A 3/72 42/90

(Continued)

*Primary Examiner* — Joshua Freeman

(57) ABSTRACT

The invention discloses devices and methods for providing a better grip on a slide associated with a semiautomatic firearm. In some embodiments, a metal frame is covered with a polymer-mineral mixture that includes steps on both a left side and a right side of a slide so as to provide maximal friction between fingers and the slide. The instant invention may aid those with wet or sweaty hands or those form whom racking a pistol is difficult by providing improved gripping features based on shape, materials, and texture of the grip enhancement elements herein described.

16 Claims, 11 Drawing Sheets

(56) References Cited

U.S. PATENT DOCUMENTS

| | | | | |
|---|---|---|---|---|
| 2013/0180152 | A1* | 7/2013 | Speroni | F41C 27/00 42/99 |
| 2015/0184959 | A1* | 7/2015 | Parnell | F41A 3/72 89/1.4 |
| 2015/0233663 | A1* | 8/2015 | Kiehn | F41C 33/001 42/90 |
| 2015/0354909 | A1* | 12/2015 | Tarantino | F41A 3/72 89/1.4 |

* cited by examiner

DEVICES AND METHODS FOR IMPROVING THE GRIP OF A SLIDE ASSOCIATED WITH A SEMI-AUTOMATIC WEAPON

The instant invention claims priority from U.S. Provisional Patent Application No. 62/162,835 filed 18 May 2015 of identical inventorship.

FIELD AND BACKGROUND OF THE INVENTION

The present invention, in some embodiments thereof, relates to methods and devices for allowing facile charging of a semi-automatic weapon. The instant invention, in some embodiments, provides for a plurality of elements for providing a better grip between a hand and a slide of such a weapon. The instant invention claims priority from U.S. Provisional Application No. 62/162,835 filed 18 May 2015 of identical inventorship.

The United States has an estimated 300 million firearms in private hands independent weapons in the hands of the armed forces, police, and other law enforcement bodies. A significant proportion of such weapons includes semi-automatic weapons, including hand guns. While such weapons may fire automatically after a first round, firing of the first round requires a user to charge a slide. The slide is generally realized as a metal element and its charging requires it to be pulled back against a firing spring. Charging or "racking" a slide, depending on the model, can be a challenge. Numerous YouTube videos address the challenge of charging a slide and methods and "tricks" for making such a task easier. Wet or sweaty hands make the task even more difficult.

Several prior art inventions have addressed the issue of slide charging difficulty. Some inventions involved a modified slide; others include elements attached to a slide or placed on a slide to allow for a better grip and greater leverage. All prior art inventions significantly change the size footprint of the gun to which the inventions are attached or employed.

U.S. patent application Ser. No. 13/588,722 to Grossman teaches a semiautomatic single action hand gun comprising a slide with a contoured grip on a breach end of the slide. A method is also disclosed. In accordance with one step of the method a single action semiautomatic firearm is provides. In accordance with another step of the method, a contoured grip for a slide of the firearm is provided. The grip comprises a plurality of depressions in an elongated strip with the depressions generally sized to accommodate the fingers of a user and the strip generally sized to fit on a lateral side of a slide of firearm. In accordance with another step in the method, the grip is applied to a lateral side of a slide of the firearm.

U.S. Pat. No. 8,312,803 issued to Oz describes a slide pull apparatus for aiding in pulling a slide on a semi-automatic pistol. The slide pull apparatus includes a shell configured to partially enclose a rear portion of a slide on a semi-automatic pistol, the shell including: a plate having an aperture of a size configured to surround at least a portion of a rear aim sight on the semi-automatic pistol. The slide pull apparatus additionally includes at least one finger tab projecting from the slide pull, the finger projection having a size configured to accommodate at least one finger of a human hand, wherein pulling on the at least one finger tab in a rearward direction causes the slide to move in a rearward direction, thereby facilitating loading of the semi-automatic pistol.

U.S. Pat. No. 8,468,734 to Meller & Faifer describes an accessory for a semi-automatic pistol having a slide, the accessory including a pair of protruding engaging members for engagement by a hand or fingers of a user, a mounting element coupled to each engaging member, for releasably mounting the engaging member on the slide of the pistol. Preferably, the accessory further includes a mounting plate slideably engagable in a rear slot of the slide, and the mounting elements are affixable to the mounting plate.

U.S. Pat. No. 8,297,176 to Buschow & Bryant teaches an improved semiautomatic comprising an assembly which reduces the effort of cocking the firearm or loading a first cartridge. A spring tube contains an inner recoil spring which is employed only during cycling of the firearm when firing. For initial cocking purposes, the inner recoil spring is bypassed in favor of a lighter outer spring which is selectively engaged by the user. When the inner recoil spring is engaged, both inner and outer springs are employed without adversely affecting the recoil dynamics of the firearm.

Handi-Racker.com describes a product that is placed against a wall or similar solid object and is used to rack a handgun. By pushing the handgun against the product, the slide is pushed in a backwards direction and thus "racked" or charged. FIG. 1 shows a view of the Handi-Racker product with a plurality of different handguns 190.

SUMMARY OF THE INVENTION

It is therefore a purpose of the present invention, in some embodiments, to describe methods and devices for providing an improved gripping system for a rear portion of a slide associated with a semi-automatic firearm.

The invention includes a device for providing improved grip on a slide associated with a semi-automatic firearm, including: a flexible metal frame adapted to fit over an end portion of a slide associated with a semi-automatic firearm, the frame further adapted to cover the slide on a left side, on a right side and on a top side of the slide; a glue adapted to be placed on a first inner side of the frame and further adapted to hold the metal frame to the slide, wherein the frame is adapted not to interfere with a rear sight associated with the firearm; two pairs of steps wherein one of the pairs is adapted to be placed on a left side of a second outer side of the metal frame and wherein one of the pairs is adapted to be placed on a right side of the second outer side of the metal frame; and, a polymer-mineral combination adapted to cover the steps and the frame on the second outer side, wherein the polymer-mineral combination is further adapted to have a rough finish.

In one aspect of the device, the semi-automatic firearm is realized as a hand gun.

In another aspect of the device, the semi-automatic firearm is realized as a semi-automatic or selective fire rifle.

In another aspect of the device, there is additionally a leg on the right side and a leg on the left side, wherein the legs are adapted to sit in a spacing between the slide and a body of the semi-automatic firearm.

In another aspect of the device, the hand gun is produced by Glock, Colt, Sig Sauer, Heckler and Koch, Springfield Armory, Beretta, Sturm-Ruger, Walther, Browning, Taurus, Luger, Bul, Jericho, or Smith and Wesson.

In another aspect of the device, the metal frame is realized as web-shaped and is made of sheet metal, aluminum, stainless steel and has a thickness of 0.2-0.3 millimeters.

In another aspect of the device, the steps are made of a polymer material, wherein a first of the steps has a thickness of 0.8 millimeters and a second of the steps has a thickness of 1.6 millimeters.

In another aspect of the device, the second step is placed further to the rear of the slide of the semi-automatic firearm than the first step.

In another aspect of the device, the glue is realized as a glue adapted to bond a first metal to a second metal or as a solder.

In another aspect of the device, the polymer of the polymer-mineral combination is selected from polyurethane or neoprene, and the mineral is selected as aluminum oxide and wherein the mineral is 30-40% of mass of the polymer-mineral combination.

In another aspect of the device, the polymer-mineral combination is further adapted to cover other parts of the firearm.

The invention provides for a method for improving traction between a user's hand and a slide associated with a semi-automatic weapon, including: providing a semi-automatic weapon; placing glue on a rear portion of a slide associated with the semi-automatic weapon; placing over the glue a flexible generally rectangular metal frame adapted to cover the rear portion and the glue, wherein the metal frame is adapted to cover a left side, a right side, and a top side of the slide; covering the metal frame with a polymer material, wherein the polymer material includes steps on the left side and the right side of the frame; and, allowing the glue to dry.

In one aspect of the method, the semi-automatic weapon is realized as a plurality of semi-automatic weapons.

In another aspect of the method, the rear portion includes a target sight.

In another aspect of the method, the covering involves attaching, gluing, heat-treatment, or sticking.

In another aspect of the method, the three steps are realized over the slide on the left side and the right side.

In another aspect of the method, the metal frame and the polymer have nearly identical dimensions, shapes, and thicknesses.

The invention additionally provides for a device for providing increased traction for an improved grip on a slide associated with a semi-automatic weapon, including: a plastic element adapted to fit snuggly over a rear portion of a slide associated with a semi-automatic weapon, wherein the element includes slats adapted to sit between a plurality of ribs on the sides of the rear portion of the slide and wherein the element is further adapted to include at least two non-identical steps on a left side and at least two non-identical steps on a right side for improved grip, wherein a taller step is closer to the rear of the slide than is a smaller step.

In one aspect of the device, the element is made by plastic extrusion.

In another aspect of the device, there is additionally glue to improve adhesion between the weapon and the element.

In another aspect of the device, the semi-automatic weapon is realized as a handgun, and wherein the slide is metallic.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. It is noted that similar elements in various drawings may have the same number, advanced by the appropriate multiple of 100.

In the drawings.

DESCRIPTION OF SPECIFIC EMBODIMENTS OF THE INVENTION

Figure 1:
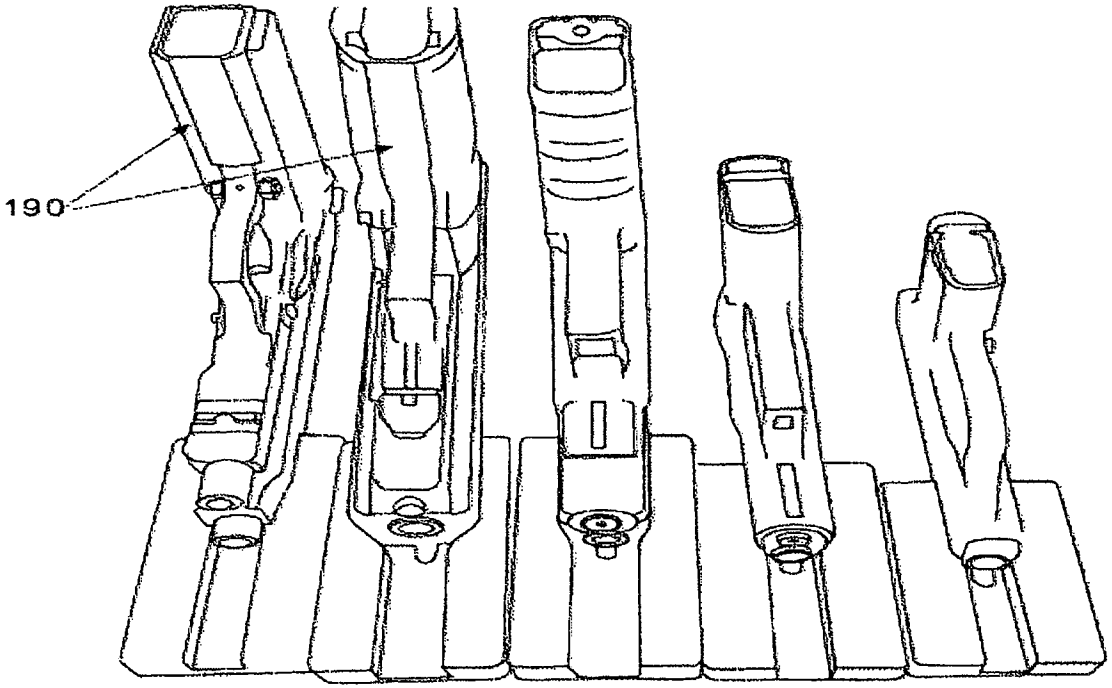
FIG. 1 PRIOR ART
FIG. 1 shows a prior art view of a racking invention.

The present invention, in some embodiments thereof, relates to methods and devices for facile racking of a slide associated with a semi-automatic weapon, particularly a handgun.

For purposes of better understanding, some embodiments of the present invention are illustrated in the figures of the drawings. Without being bound by any theory, the following discussion is offered. Semi-automatic handguns require racking of a metal slide prior to firing a first shot. Racking can be difficult due to the spring(s) against which the slide is pressed. The task can be even more difficult if one's hands are wet or sweaty. Handguns are generally used in self-defense. A split second can be the difference between life and death: an inability to rack a gun because of wet hands or a poor grip could possibly lead to a fatal delay.

In some embodiments of the instant invention described in more detail below, three aspects of a slide attachment are defined and optimized to make gripping and racking the slide that much easier:

1. The material used in covering a rear portion of a slide to allow for better gripping
2. "Steps" of appropriate size and spacing to provide for improved pushing power of fingers on the slide; and,
3. A roughened surface to further aid in optimized grip of the slide for ease of racking and gun use.

As to the first point, in some of the embodiments below, a polymer or plastic is applied over the rear of a slide so as to allow for better finger gripping than is provided for by metal. Properly-chosen polymers offer better grip potential than slats traditionally included in semi-automatic handgun slides available today. Additionally, grit or minerals of appropriate diameter added to the polymer give a higher degree of friction between finger and slide. The steps, generally 2-3 in number, provide added resistance against fingers pushing against the slide by providing improved vertical surface area for finger pressure. Whereas a naked slide does not offer facile resistance to wet/sweaty fingers, the steps described herewith cause fingers to stop so that all energy expended is directed towards racking of the weapon. Finally, the polymer, plastic, or polymer-mineral coating is given a roughened texture to further aid in the tight association between a user's fingers and the slide during weapon racking.

First Embodiment

The invention includes a device for providing improved grip on a slide associated with a semi-automatic firearm, including: a flexible metal frame adapted to fit over an end portion of a slide associated with a semi-automatic firearm, the frame further adapted to cover the slide on a left side, on a right side and on a top side of the slide; a glue adapted to be placed on a first inner side of the frame and further adapted to hold the metal frame to the slide, wherein the frame is adapted not to interfere with a rear sight associated with the firearm; two pairs of steps wherein one of the pairs is adapted to be placed on a left side of a second outer side of the metal frame and wherein one of the pairs is adapted to be placed on a right side of the second outer side of the metal frame; and, a polymer-mineral combination adapted to cover the steps and the frame on the second outer side, wherein the polymer-mineral combination is further adapted to have a rough finish.

In one aspect of the device, the semi-automatic firearm is realized as a hand gun. In another aspect of the device, the semi-automatic firearm is realized as a semi-automatic or selective fire rifle. In another aspect of the device, the hand gun is produced by Glock, Colt, Sig Sauer, Heckler and Koch, Springfield Armory, Beretta, Sturm-Ruger, Walther, Browning, Taurus, Luger, Bul, Jericho, or Smith and Wesson. In another aspect of the device, the metal frame is realized as web-shaped and is made of sheet metal, aluminum, stainless steel and has a thickness of 0.2-0.3 millimeters. In another aspect of the device, the steps are made of a polymer material, wherein a first of the steps has a thickness of 0.8 millimeters and a second of the steps has a thickness of 1.6 millimeters. In another aspect of the device, the second step is placed further to the rear of the slide of the semi-automatic firearm than the first step. In another aspect of the device, the glue is realized as a glue adapted to bond a first metal to a second metal or as a solder. In another aspect of the device, the polymer of the polymer-mineral combination is selected from polyurethane or neoprene, and the mineral is selected as aluminum oxide and wherein the mineral is 30-40% of mass of the polymer-mineral combination. In another aspect of the device, the polymer-mineral combination is further adapted to cover other parts of the firearm. It is understood that the list of firearm manufacturers is non-limiting and is offered in the way of examples of products amenable to embodiments of the instant invention.

Figure 2B:
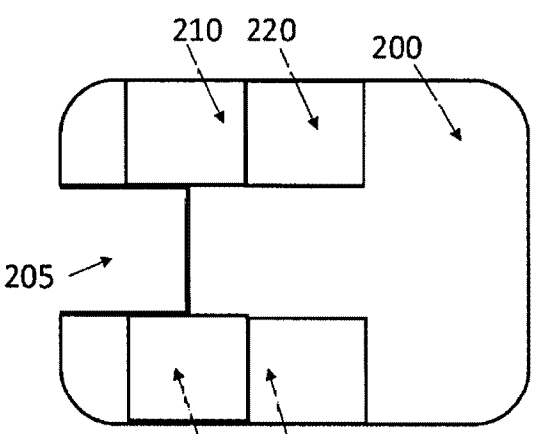
FIGS. 2A-2 D show schematic views of an assembly associated with an embodiment of the instant invention.
Figure 2D:
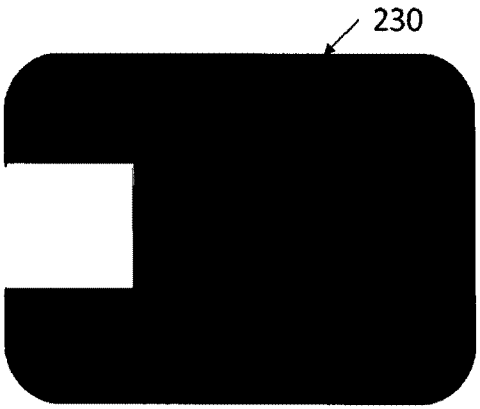
Figure 2A:
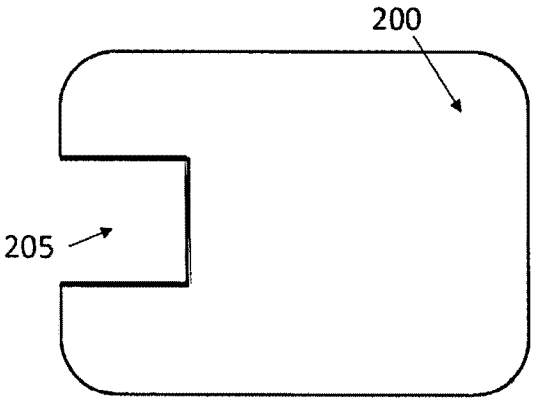

Attention is turned to FIG. 2A, which shows a schematic view of an aspect of the instant embodiment. FIG. 2A shows a piece of metal 200 which serves may serve as a base for the instant embodiment. The metal 200 is of a size to fit easily over the back portion of a slide of a handgun (not shown). It is understood that the metal 200 is not required for all embodiments as one could practice embodiments of the instant invention wherein the improved slide grip is built directly onto the metal slide during manufacture. The instant embodiment primarily deals with weapons that were produced with a traditional metal slide and possibly slats or other features on the rear of the slide.

The metal 200 may be designed to leave space 205 for a rear sight. As much, in many applications, the instant embodiment must be produced "gun-specific". Just as the prior art figure (FIG. 1) shows elements adapted to the size of handguns 190, so too in the instant invention, the size of the metal (FIG. 2A) 200 and any features such as space 205 for sights or other features must be designed for the specific weapon in mind. Also, the size of the metal 200 is dependent on the size of the slide over which the metal is ultimately placed.

FIG. 2B shows a plurality of steps 210, 220 placed over a portion of the metal 200. The steps 210, 220 may be realized as separate elements as shown in FIG. 2B or they may be incorporated during production of the coating placed over the metal 200. Steps 210 are higher than steps 220 and steps 210 are closer to user than are steps 220. This arrangement leads to greater finger resistance as one pushes against the steps 210, 220 during slide racking.

Figure 2C:
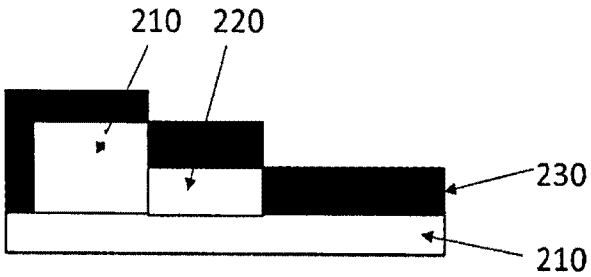

FIG. 2C shows a side view cutaway of a polymer-mineral coating 230 placed over the metal 200 and the steps 210, 220. The coating 230 contacts the metal 200 as well as the top of the steps 210, 220. FIG. 2D shows a top view of the polymer-mineral coating 230.

Figure 3:
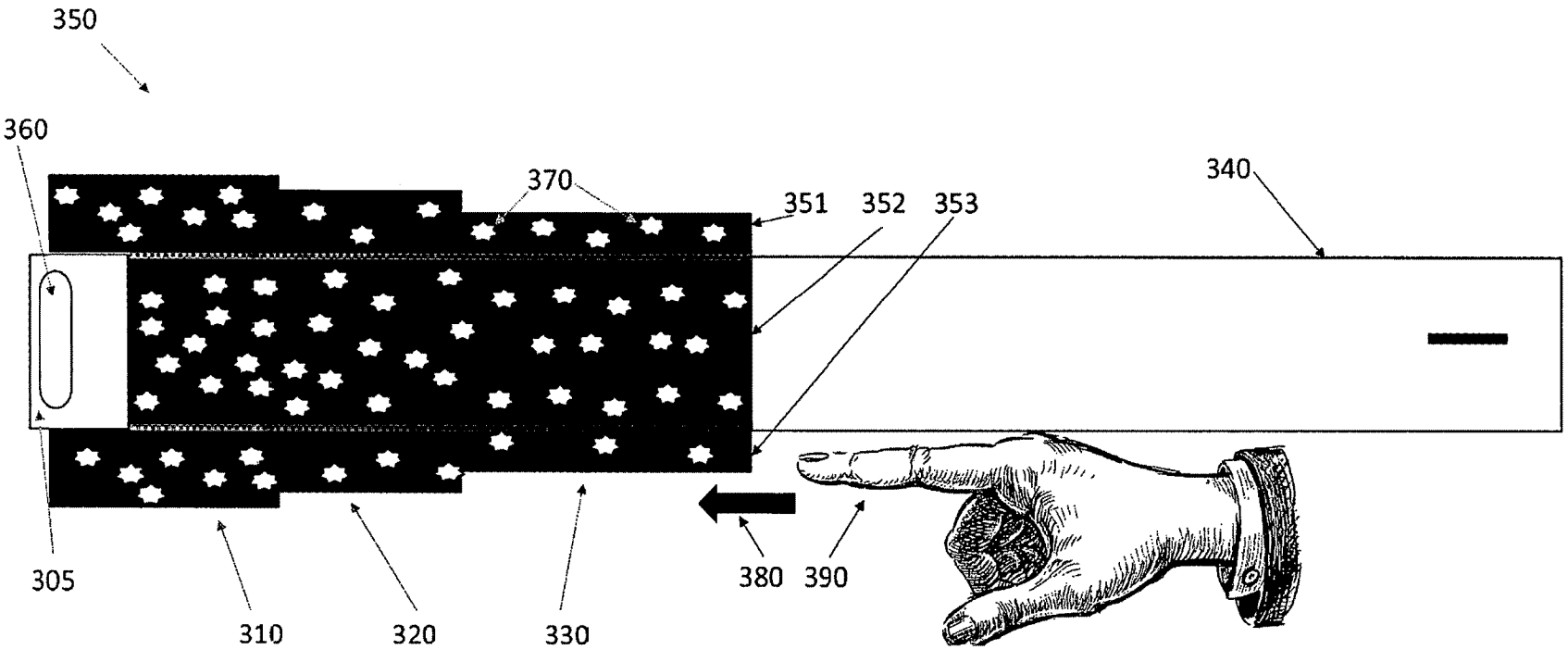
FIG. 3 shows a schematic view of a slide gripping unit in place.

Attention is turned to FIG. 3. A slide 340 of a handgun is shown. A slide gripping unit 350 is placed over the rear portion of the slide 340. The slide gripping unit 350 includes a space 305 adapted not to interfere with a rear sight 360 associated with the slide 340. The slide gripping unit 350 completely covers the left side 351, top 352, and right side 353 of the slide 340. The polymer-mineral coating 330 includes approximately 40% mineral 370 which provides a sandpaper-like resistive feel. Steps 310 & 320 aid when the slide 340 is pushed 380 backwards during a normal racking action. Note that the steps 310 & 320 together with the polymer-mineral coating 330 sitting on it metal base (not visible from this view) lead effectively to three steps above the base slide 340. These three steps allow for easier racking when pushing 380 back on the slide gripping unit. A roughened surface with minerals 370 makes finger 390 grip more complete.

Figure 4:
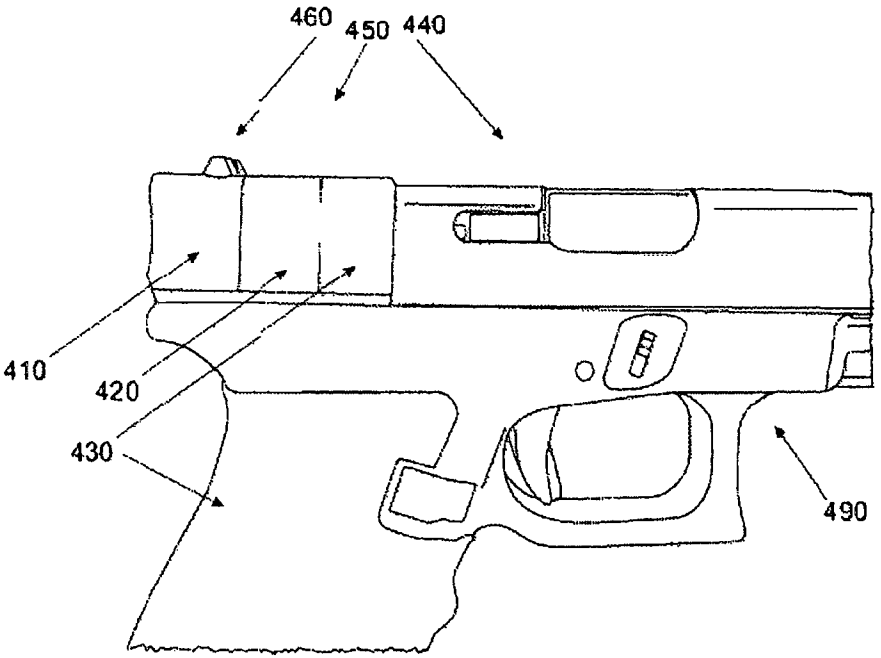
FIG. 4 shows a picture of a Glock pistol with a slide gripping unit prototype in place.

Attention is directed to FIG. 4 which shows a Glock semiautomatic pistol 490 including a prototype of the instant invention. Slide 440 is surrounded by a slide gripping unit 450 which includes visible stairs 410 & 420. The polymer-mineral coating has been replaced with a polymer-Velcro coating 430. Velcro provides additional friction between a user's hand/fingers and the slide 440. The slide gripping unit 450 is held in place by a 3M branded glue and covers both sides as well as the top of the slide. Note the rear sight 460 of the Glock which is not in any way obstructed by the slide gripping unit 450. The polymer-Velcro coating 430 has also been glued to the handle to add in handle gripping quality.

Second Embodiment

Figure 5:
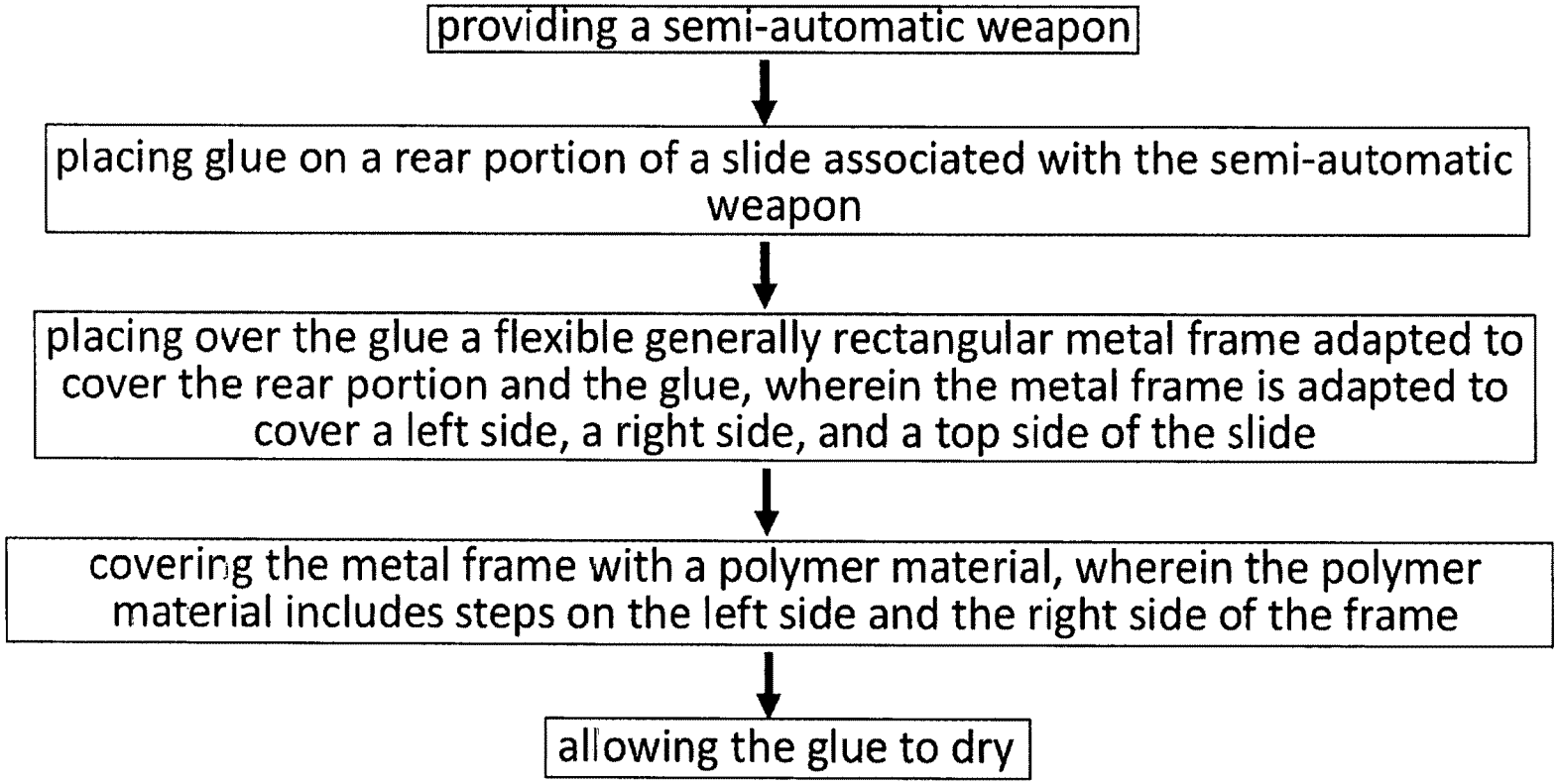
FIG. 5 shows a flowchart for an alternative embodiment of the invention.

Attention is turned to FIG. 5 which shows a flowchart for an embodiment of the instant invention. The invention provides for a method for improving traction between a user's hand and a slide associated with a semi-automatic weapon, including: providing a semi-automatic weapon; placing glue on a rear portion of a slide associated with the semi-automatic weapon; placing over the glue a flexible generally rectangular metal frame adapted to cover the rear portion and the glue, wherein the metal frame is adapted to cover a left side, a right side, and a top side of the slide; covering the metal frame and a polymer material, wherein the polymer material includes steps on the left side and the right side of the frame; and, allowing the glue to dry.

In one aspect of the method, the semi-automatic weapon is realized as a plurality of semi-automatic weapons. In another aspect of the method, the rear portion includes a target sight. In another aspect of the method, the covering involves attaching, gluing, heat-treatment, or sticking. In another aspect of the method, the three steps are realized over the slide on the left side and the right side. In another aspect of the method, the metal frame and the polymer have nearly identical dimensions, shapes, and thicknesses.

It is understood that the instant invention could be practiced in some embodiments in the absence of covering the top of the slide; one could glue the metal frame and its associated layers and steps to the right and left side of the slide only. Additionally, the instant invention may be practiced without the metal frame if the polymer layer is attached directly to the slide during or after weapon manufacture. The metal frame, in some embodiments, may be realized as a metal mesh. The steps may be composed of the polymer material through proper molds without recourse to separate steps being placed between the metal frame and the polymer material. The polymer material may be any appropriate synthetic or natural material. The polymer may material may include plastics as well as rubbers and may be made via a combination of polymeric materials. Neoprene and polyurethane are non-limiting examples of polymer materials amenable for use as the polymer material herein described. The steps are generally selected in size (both rise and length) to allow for facile contact with fingers during firearm racking.

Third Embodiment

The invention additionally provides for a device for providing increased traction for an improved grip on a slide associated with a semi-automatic weapon, including: a plastic element adapted to fit snuggly over a rear portion of a slide associated with a semi-automatic weapon, wherein the element includes slats adapted to sit between a plurality of ribs on the sides of the rear portion of the slide and wherein the element is further adapted to include at least two non-identical steps on a left side and at least two non-identical steps on a right side for improved grip, wherein a taller step is closer to the rear of the slide than is a smaller step.

In one aspect of the device, the element is made by plastic extrusion. In another aspect of the device, there is additionally glue to improve adhesion between the weapon and the element. In another aspect of the device, the semi-automatic weapon is realized as a handgun, and wherein the slide is metallic.

Figure 6:
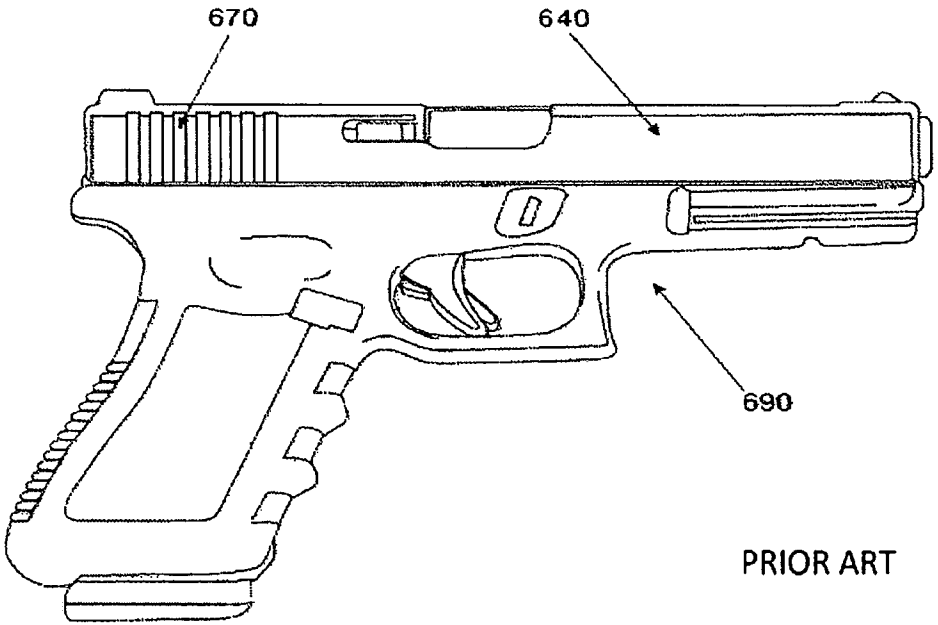
PRIOR ART FIG. 6
FIG. 6 shows a picture of a handgun.

As described above, embodiments of the instant invention may generally be produced for specific firearms or groups of firearms based on shape, rear sight location and size, as well as slide dimensions and shape. FIG. 6 shows an image of a commercially-available handgun 690. Note slats 670 designed in part to aid in gripping the slide 640 during racking.

Figure 7C:
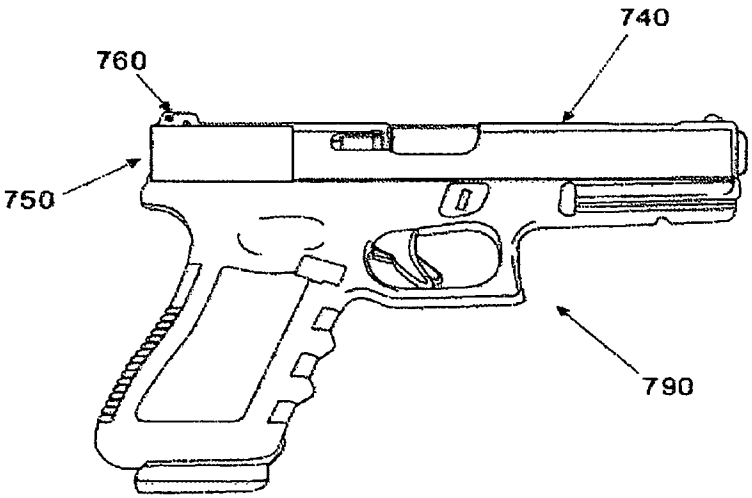
FIGS. 7A-7C show schematic views of an embodiment of the instant invention.
Figure 7A:
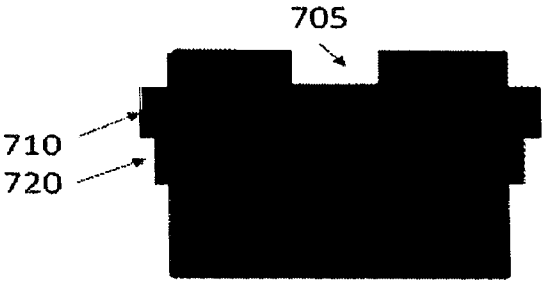
Figure 7B:
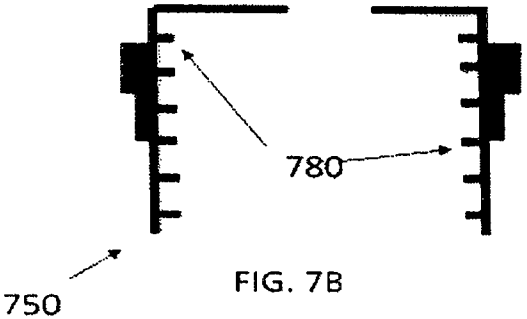

Attention is turned to FIG. 7A which shows a schematic view of a hard plastic slide gripping unit 750. The unit is extruded with steps 710 & 720 as well as in a shape to leave a space 705 for a rear sight. The hard plastic unit 750 is produced in a size and shape so as to fit a predetermined handgun or group of similarly-sized and shaped handguns. FIG. 7B shows a cutaway of the slide gripping unit 750 to reveal pins 780 adapted to sit in the slats seen on the side of the handgun in FIG. 6. FIG. 7C shows the slide-gripping unit 750 sitting in place on the handgun 790 with the rear sight 760 unobstructed. Optionally, glue, resin, solder or other material may be placed between the slide-gripping unit 750 and the slide 740 to aid making a tight fit between the two.

Example

Figure 8:
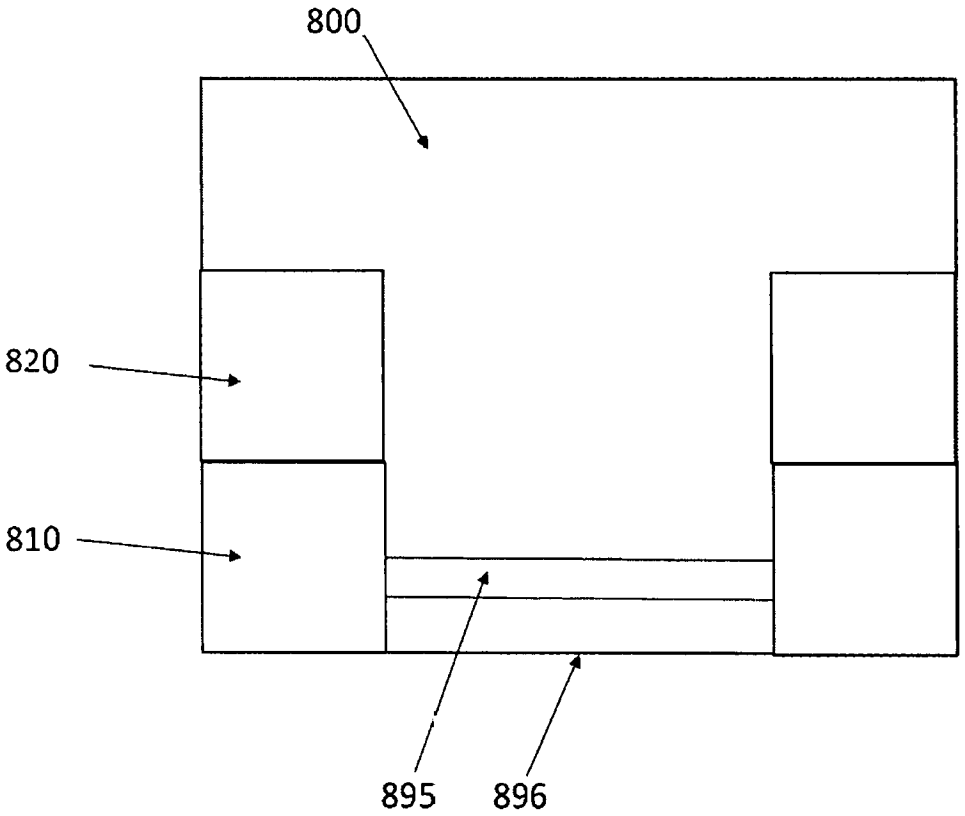
FIG. 8 shows a schematic setup associated with an Example of the invention.
Figure 9:
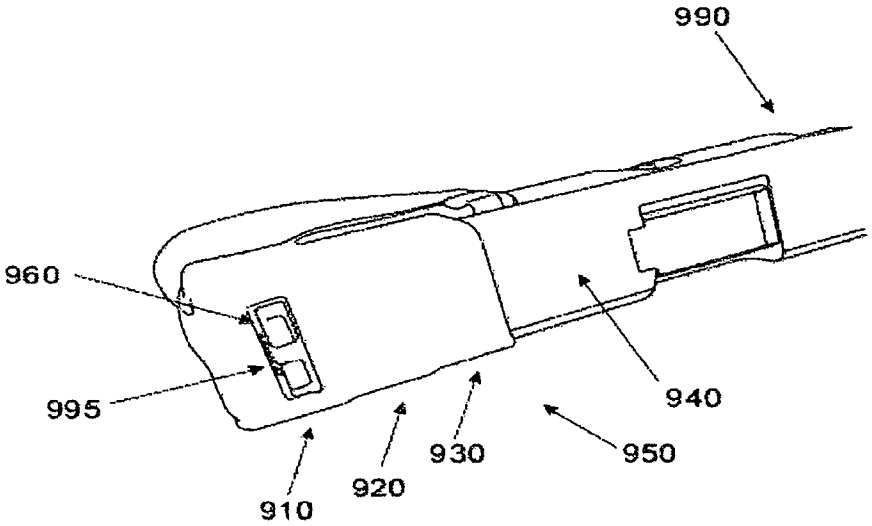
FIG. 9 shows a photograph of the final grip improving element associated with a Glock semiautomatic pistol.

A Glock semiautomatic pistol was provided. A piece of sheet metal 0.7 mm in thickness was produced with dimensions of 65 millimeters by 54 millimeters. 18 millimeters from a first end of the sheet metal was placed a piece of plastic having dimensions of 18 mm×18 mm with a height of 0.8 mm. Immediately next to it was placed two such pieces of plastic having an overall footprint on the sheet metal of 18 mm×18 mm with a height above the sheet metal of 1.6 mm. A similar arrangement was produced on the opposite side of the sheet metal. See FIG. 8 which shows a schematic of the sheet metal 800 with the steps 810 & 820 having differential heights (step 820 being taller than step 810) as well as a window 895 7 mm×29 mm adapted for the Glock's rear sight at a distance of 6.5 mm from the end 896 of the sheet metal 800. A piece of polyurethane (not shown) with a self-adhesive layer was cut to 65 mm×54 mm with an identical window 895 and bonded to the sheet metal 800. The polyurethane included Velcro elements. FIG. 9 shows the Glock 990 with the slide gripping unit 950 after the latter was glued in place with a metal-metal glue provided by 3M. The window 995 allows for unfettered use of the Glock's 990 rear sight 960. Steps 910 & 920 are visible under the polymer-Velcro cover 930, which also serves as a step relative to the metal slide 940 of the semiautomatic pistol 990.

Fourth Embodiment

Figure 10:
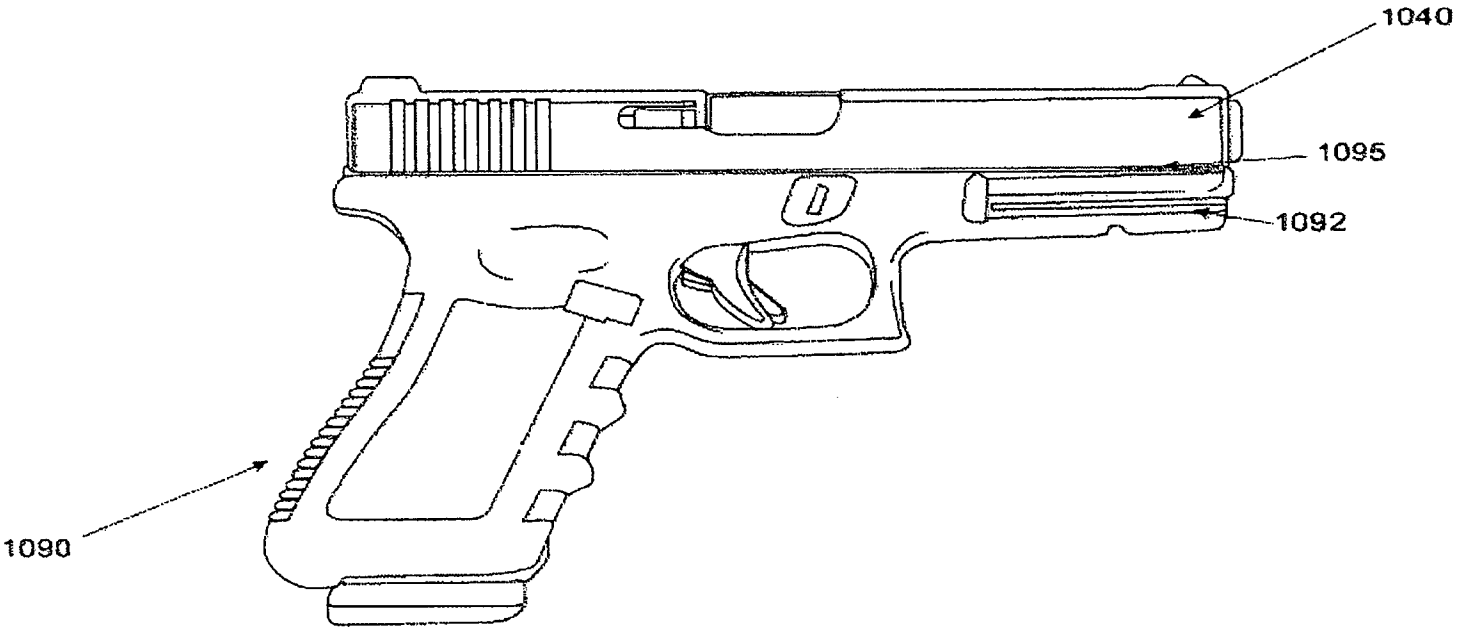
FIG. 10 shows a photograph of a handgun.
Figure 11C:
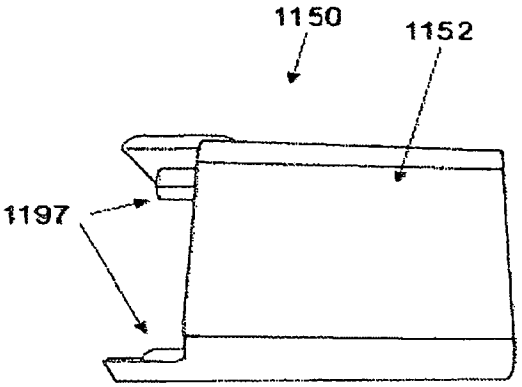
FIGS. 11A-11C show photographs of an additional embodiment of the invention.
Figure 11B:
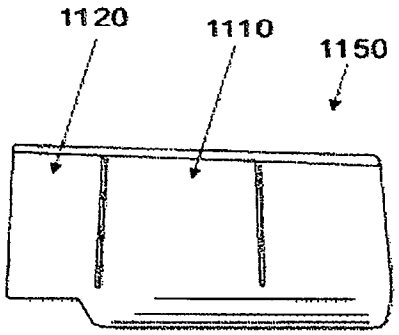
Figure 11A:
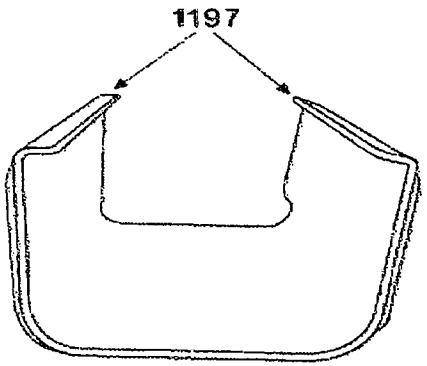

Attention is turned to FIG. 10 which shows a semiautomatic pistol 1090. Between the body 1092 and the slide 1040 is a spacing 1095 of 0.3 millimeters. This spacing 1095 runs the length of the slide 1040. Attention is turned to FIG. 11A which shows an additional embodiment of the instant invention. A slide gripping unit 1150 includes legs 1197 of 0.2 mm width adapted to fit snugly in the spacing 1095 shown previously in FIG. 10. FIG. 11B shows a side view of the slide gripping unit 1150 which again includes steps 1110 & 1120. FIG. 11C shows a top view of the slide gripping unit 1150 that includes a top 1152 portion which fits over a slide (not shown) and legs 1197 used to grip a semiautomatic handgun. The instant embodiment, by fitting snuggly into the spacing between a slide and the body of a handgun, optionally does not require any glue. The legs 1197 are secure enough to keep the slide gripping unit 1150 in place and thus allow for faster incorporation, easier attachment, and no requirement for expert alignment.

Some handguns do not include a spacing 1095 as shown in FIG. 10. For such guns, a small flange may be included on either side of the slide over which legs (FIG. 11A, 1197) may be attached either as is or with the assistance of glue. Thus, a spacing or flanges may be used to attach legs 1197 of a slide gripping unit to the slide of a semiautomatic handgun to allow for more facile charging.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range. In addition, as used herein the term "about" refers to +/−10%. In addition, when the word "about" is used herein in reference to a number, it should be understood that still another embodiment of the invention includes that number not modified by the presence of the word "about."

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals there between.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A device for providing improved grip on a slide associated with a semi-automatic firearm, including:

a flexible metal frame adapted to fit over an end portion of a slide associated with a semi-automatic firearm, said frame further adapted to cover said slide on a left side, on a right side and on a top side of said slide;

a glue adapted to be placed on a first inner side of said frame and further adapted to hold said metal frame to said slide, wherein said frame is adapted not to interfere with a rear sight associated with said firearm;

two pairs of steps wherein one of said pairs is adapted to be placed on a left side of a second outer side of said metal frame and wherein one of said pairs is adapted to be placed on a right side of said second outer side of said metal frame; and, a polymer-mineral combination adapted to cover said steps and said frame on said second outer side, wherein said polymer-mineral combination is further adapted to have a rough finish.

2. The device according to claim 1, wherein said semi-automatic firearm is realized as a hand gun, semi-automatic rifle or selective fire rifle.

3. The device according to claim 1, further including a leg on said right side and a leg on said left side, wherein said legs are adapted to sit in a spacing between said slide and a body of said semi-automatic firearm.

4. The device according to claim 2, wherein said hand gun is produced by Glock, Colt, Sig Sauer, Heckler and Koch, Springfield Armory, Beretta, Sturm-Ruger, Walther, Browning, Taurus, Luger, Bul, Jericho, or Smith and Wesson.

5. The device according to claim 1, wherein said metal frame is realized as web-shaped and is made of sheet metal, aluminum, stainless steel and has a thickness of 0.2-0.3 millimeters.

6. The device according to claim 1, wherein said steps are made of a polymer material, wherein a first of said steps has a thickness of 0.8 millimeters and a second of said steps has a thickness of 1.6 millimeters.

7. The device according to claim 6, wherein said second step is placed further to the rear of said slide of said semi-automatic firearm than said first step.

8. The device according to claim 1, wherein said glue is realized as a glue adapted to bond a first metal to a second metal or as a solder.

9. The device according to claim 1, wherein said polymer-mineral combination is selected from polyurethane or neoprene, and wherein said mineral is selected as aluminum oxide and said mineral is 30-40% of mass of the polymer-mineral combination.

10. The device according to claim 9, wherein said polymer-mineral combination is further adapted to cover other parts of said firearm.

11. A method for improving traction between a user's hand and a slide associated with a semi-automatic weapon, including:

providing a semi-automatic weapon;

placing glue on a rear portion of a slide associated with said semi-automatic weapon;

placing over said glue a flexible generally rectangular metal frame adapted to cover said rear portion and said glue, wherein said metal frame is adapted to cover a left side, a right side, and a top side of said slide;

covering said metal frame with a polymer material, wherein said polymer material includes steps on said left side and said right side of said frame; and, allowing said glue to dry.

12. The method according to claim 11, wherein said semi-automatic weapon is realized as a plurality of semi-automatic weapons.

13. The method according to claim 1, wherein said rear portion includes a target sight.

14. The method according to claim 13, wherein said covering involves attaching, gluing, heat-treatment, or sticking.

15. The method according to claim 11, wherein three steps are realized over said slide on said left side and said right side.

16. The method according to claim 11, wherein said metal frame and said polymer have nearly identical dimensions, shapes, and thicknesses.

* * * * *